US006079391A

United States Patent [19]

Eyberg et al.

[11] Patent Number: 6,079,391

[45] Date of Patent: Jun. 27, 2000

[54] FUEL INJECTION SYSTEM FOR INTERNAL COMBUSTION ENGINES

[75] Inventors: Wilhelm Eyberg, Leonberg; Rainer Burkel, Asperg; Bernhard Bronkal, Koengen; Norbert Knab, Appenweier; Martin Grosser, Korntal-Muenchingen; Andreas Werner, Reichenbach; Bernd Spielmann, Ingersheim; Rainer Oettinger, Wiernsheim; Peter Schubert, Leingarten; Klaus Scherer, Gerlingen, all of Germany

[73] Assignee: Robert Bosch GmbH, Stuttgart, Germany

[21] Appl. No.: 08/836,357

[22] PCT Filed: Apr. 24, 1996

[86] PCT No.: PCT/EP96/01700

§ 371 Date: May 14, 1997

§ 102(e) Date: May 14, 1997

[87] PCT Pub. No.: WO97/10431

PCT Pub. Date: Mar. 20, 1997

[30] Foreign Application Priority Data

Sep. 14, 1995 [DE] Germany ..... 195 34 050

[51] Int. Cl.[7] ..... F02M 41/00

[52] U.S. Cl. ..... 123/456; 123/198 D; 123/468; 138/104

[58] Field of Search ..... 123/468, 469, 123/198 D, 198 DB, 470, 472; 138/104

[56] References Cited

U.S. PATENT DOCUMENTS

| | | | |
|---|---|---|---|
| 3,194,221 | 7/1965 | Dinger | 123/469 |
| 3,783,842 | 1/1974 | Kuhn | 123/469 |
| 4,209,041 | 6/1980 | Loukonen | 138/104 |
| 4,675,221 | 6/1987 | Lalikos | 138/104 |
| 5,002,030 | 3/1991 | Mahnke | 123/456 |
| 5,129,428 | 7/1992 | Winter | 138/104 |
| 5,179,922 | 1/1993 | Bartholomew | 123/198 DB |
| 5,239,964 | 8/1993 | Diener | 123/469 |
| 5,284,184 | 2/1994 | Noone | 138/104 |
| 5,533,485 | 7/1996 | Bronkal | 123/468 |
| 5,622,210 | 4/1997 | Crisman | 138/104 |

FOREIGN PATENT DOCUMENTS

| | | | |
|---|---|---|---|
| 3018781 | 12/1981 | Germany | 138/104 |
| 0900045 | 1/1982 | U.S.S.R. | 123/468 |

*Primary Examiner*—Carl S. Miller
*Attorney, Agent, or Firm*—Edwin E. Greigg; Ronald E. Greigg

[57] ABSTRACT

A fuel injection system for internal combustion engines in which a high pressure fuel reservoir is provided, from which fuel is supplied to injection valves in an electrically controlled manner. In order to reduce damage which occurs when there are leaks from the high pressure reservoir, the high pressure reservoir is enclosed by a sheath that can capture the emerging leakage fuel.

20 Claims, 1 Drawing Sheet

FUEL INJECTION SYSTEM FOR INTERNAL COMBUSTION ENGINES

PRIOR ART

The invention relates to a fuel injection system for internal combustion engines. A fuel injection system of this kind has been disclosed by DE 43 18 078 A1 U.S. Pat. No. 5,458,103.

In fuel injection systems of this kind, considerable pressures of well over 1,000 bar occur in the high pressure reservoir. Since high pressure reservoirs of this kind also have connection points for pressure lines and connection points for fuel delivery, there is a danger of leakage. As a rule, leakage points have very small cross sections and when there is constant high fuel pressure in the high pressure reservoir, these leakage lead to thin-streamed, hardly visible fuel leaks of a type similar to the fuel injection streams that automatically occur in unit fuel injectors. Fuel streams of this kind have a considerable kinetic energy which can be destructive and in particular, can also be a threat to people working in the vicinity of high pressure fuel reservoirs of this kind.

ADVANTAGES OF THE INVENTION

The invention has the advantage over the prior art that the fuel emerging through the sheath is captured and then can be diverted so that the above mentioned damage does not occur. Advantageously, the sheath is comprised of a sleeve embodied in the form of a mesh, which permits a maximum of flexibility and fatigue endurance and nevertheless, reliably prevents the emission of damaging fuel streams. In a further embodiment, it is particularly advantageous to provide a capture device for the emerging fuel, which can be advantageously monitored according to claim 6 by a fluid level metering device. As a result, not only are the dangers of fuel emission from the high pressure reservoir prevented, but also fuel is prevented from being emitted in an uncontrolled manner for a longer time. In a particularly simple manner, the high pressure reservoir is accommodated inside a cylinder head cover that is already to be provided in the engine and closes off the gas exchange valve drive from the outside, on the one hand, to prevent damage and on the other hand, to capture lubricating oil that is returned to the oil collecting reservoir of the engine via an oil return. This also simultaneously serves to take in leakage fuel emerging from the high pressure reservoir. Here, too, a monitoring of the fluid level in the oil collecting reservoir is advantageously provided, in particular so that the lubricating oil of the engine also does not undergo an excessive dilution by means of the fuel and the fact of such an incipient dilution is rapidly indicated and/or too great a dilution is automatically prevented if need be by means of control interventions.

BRIEF DESCRIPTION OF THE DRAWING

Three exemplary embodiments of the invention are shown in the drawings. They are explained in detail in the description below.

DESCRIPTION OF THE EXEMPLARY EMBODIMENTS

Figure 1:
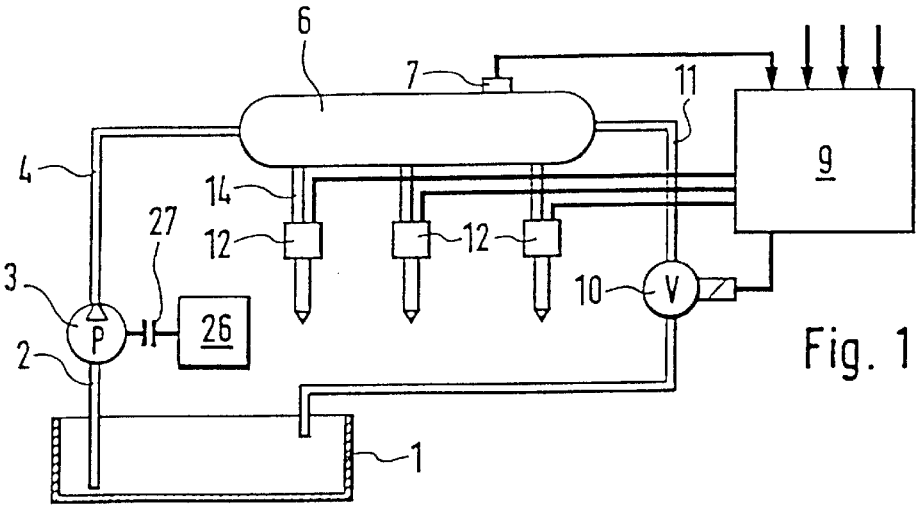
FIG. 1 shows a schematic representation of a fuel injection system.

FIG. 1 schematically represents a fuel injection system that has a fuel reservoir 1 from which a high pressure delivery pump 3 aspirates fuel via a suction line 2 and feeds it at high pressure via a pressure line 4 into a high pressure fuel reservoir 6. The fuel pressure in this high pressure fuel reservoir is monitored by a pressure sensor 7 and the value transmitted by this sensor is compared to a set point value in a control device 9. When there is a deviation, a pressure adjusting device 10 is triggered, e.g. of the kind in which excess fuel is returned to the tank once again via an adjustable valve disposed in a discharge line 11 of the high pressure fuel reservoir 6.

In a proper manner, a number of fuel injection valves 12 are supplied with fuel from the high pressure fuel reservoir via pressure lines 14. The injection time and injection duration of fuel via these fuel injection valves is electrically controlled, e.g. by solenoid valves, which are triggered by the control device 9 according to the demands as to speed and load, for example.

Figure 2:
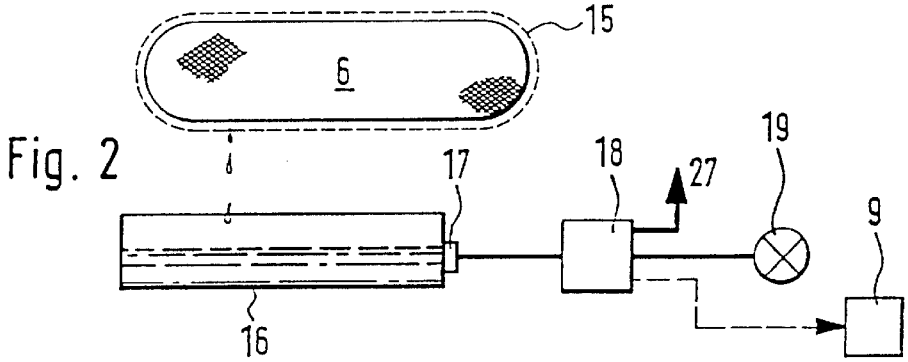
FIG. 2 shows a first embodiment according to the invention of a sheath of the high pressure reservoir of the fuel injection system.

Whereas in known high pressure reservoirs for fuel injection systems of this kind, no safety measures have been taken, which in the event of a leak in the high pressure fuel reservoir, indicate this occurrence or act on the fuel injection system in a controlling manner in such a way that, for example, this leak is stopped or the system is reduced to an emergency operation, now a safety device of this kind is provided in accordance with the exemplary embodiment of the invention according to FIG. 2. In the exemplary embodiment according to FIG. 2, in turn, the high pressure reservoir 6 is represented schematically. Now, in a first embodiment of the invention, a sleeve comprised of a fine steel mesh 15 is placed around this high pressure reservoir. Alternatively, though, this sheath can also be comprised of a net-like structure that is produced in another manner, e.g. a slit sheet metal, as is possible with expanded metal.

Preferably the net-like sheath 15 is comprised of mechanically resistant material, in particular metal, which encompasses the high pressure fuel reservoir on all sides. The sheath, though, can also be comprised of plastic or glass/carbon fiber material that is highly stable in relation to the fuel coming out. A reduction of the enclosure, though, can also be limited to the areas in which connections have been produced between the high pressure fuel reservoir and other parts of the fuel injection system, in particular connections of the detachable kind. This sheath prevents damage from being caused by fuel coming out at leakage points that emerges in a fine stream with high kinetic energy (similar to an injection stream of a unit injector) because of the high pressure. The use of this sheath achieves the fact that fuel coming out at leakage points that emerges in a fine stream with high kinetic energy (similar to an injection stream of a unit injector) due to the high pressure is impeded so that fuel streams of this kind cannot cause any damage. The stream is captured or interrupted by the sheath and can no longer be a danger to people working in the vicinity of the high pressure reservoir. Because of the net-like structure of the sheath in the form of a steel mesh, this sheath is very flexible and can best be adapted to geometric shapes. Nevertheless, this kind of steel mesh or alternative embodiments offer the possibility that the leakage fuel can in the end also escape from the sheath and can be captured in a capture device. Here, a fluid level can be developed which is then in turn detected by a fluid level metering device 17 and is supplied to a control device 18, by means of which a signal device 19 or a control signal can be transmitted to the control device 9 for the purpose of influencing the fuel injection system. The fuel injection system can be influenced with a signal of this kind so that it is stopped under certain circumstances by virtue of the fact that the high pressure delivery pump 3 is switched off or by virtue of the fact that the pressure in the high pressure reservoir 6 is reduced to a low value via the pressure adjustment device 10, which low value is still high enough to maintain a certain emergency operation. Or else the pressure of the high pressure reservoir is reduced all the way and the activity of the injection valves is also brought to zero. Finally, it is also conceivable to trigger only a part of the fuel injection valves when a remaining fuel supply exists. A switching off of the high pressure delivery pump 3 can also occur by virtue of the fact that an electrically switchable coupling 27 is provided between this pump and its drive mechanism 26 and can be switched for example by the control device 18. This coupling can be switched not only with the occurrence of an above described leak, but also in the event of other malfunctions of the fuel injection system, e.g. in the event of defective operation of the engine, or also in selected operating states, which require a reduction of the pressure in the high pressure reservoir. The switching off of the high pressure delivery pump can be checked by means of a test cycle.

Figure 3:
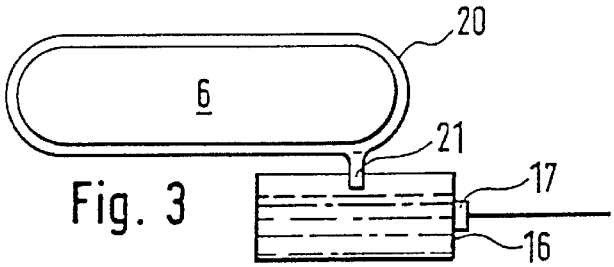
FIG. 3 shows a second exemplary embodiment of a sheath of the high pressure reservoir, with an essentially closed jacket made of sheet metal.

A modification of the invention is comprised in the embodiment according to FIG. 3, in which the high pressure fuel reservoir is now encompassed by a closed sheath, which has only one exit 21 for the fuel. Here too, though, a capture device 16 is provided of the same type as in FIG. 2. With this embodiment, it is assured that the environment of the high pressure reservoir is in no way acted upon by fuel when leaks occur.

Figure 4:
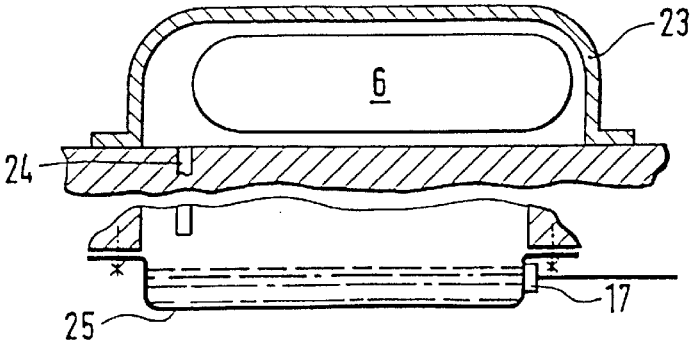
FIG. 4 shows a simplified schematic representation of a third exemplary embodiment of the invention with a high pressure reservoir accommodated inside a cylinder head cover.

A final embodiment according to FIG. 4 is comprised in that the high pressure reservoir 6 is accommodated inside chambers already provided in the engine. This occurs in this instance by virtue of the fact that the high pressure fuel reservoir 6 is accommodated under the cylinder head cover 23 of the engine, which usually closes the gas exchange valve drive off from the outside and protects it from contamination, and finally, also returns the oil that lubricates the drive mechanism to the oil collecting reservoir 25 of the engine via a return line 24. The leakage fuel that occurs can now also be removed via this oil return. The fluid level metering device 17 is in turn provided and functions in the same way as the one according to FIG. 2 so that the oil quality does not decrease under the demands and so that the leakage occurring in the high pressure fuel reservoir can finally be detected.

The embodiment according to the invention consequently produces a device which reliably prevents damage which occurs due to leakage losses in the high pressure fuel reservoir of the fuel injection system and on the other hand, permits these leaks to be punctually detected in order to take corresponding countermeasures.

The foregoing relates to preferred exemplary embodiments of the invention, it being understood that other variants and embodiments thereof are possible within the spirit and scope of the invention, the latter being defined by the appended claims.

What is claimed and desired to be secured by Letters Patent of: the United States is:

1. A fuel injection system for internal combustion engines, comprising a high pressure delivery pump (3), which supplies fuel into a high pressure fuel reservoir (6), from which a number of fuel injection valves (12) are supplied with fuel via pressure lines (14) connected directly to said reservoir, a valve control means (9), said valve control means electrically controls each of said fuel injection valves, and the high pressure reservoir (6) has a leakage fuel capture device in the form of an at least partial sheath (15, 20, 26) which surrounds at least a portion of the high pressure reservoir.

2. The fuel injection system according to claim 1, in which the sheath has at least one exit opening (21, 24) for leakage fuel.

3. The fuel injection system according to claim 2, in which the sheath is comprised of plastic or glass fiber.

4. The fuel injection system according to claim 2, in which the sheath is comprised of a metal sleeve that is embodied in the form of a mesh.

5. The fuel injection system according to claim 4, in which the sleeve is a steel mesh (15).

6. The fuel injection system according to claim 2 in which a capture device (16, 25) for fuel discharging from the sheath is disposed underneath the sheath (15) and is provided with a fuel return.

7. The fuel injection system according to claim 6, in which the capture device (16, 25) has a fluid level metering device (17) that transmits a control signal when a particular fluid level is achieved, which signal can control a display device (19) or a control device (9).

8. The fuel injection system according to claim 2, in which the sheath is constituted by a cylinder head cover (23) of the engine and the leakage fuel is removed into an oil collecting reservoir (25),of the engine via an oil return (24) of the gas exchange valve drive mechanism.

9. The fuel injection system according to claim 8, in which a fluid level metering device (17) is provided in the oil collecting reservoir (25) which device can detect a fluid level increase in the oil collecting reservoir (25) and can control a display device (19) or a control device (9) when a particular fluid level is attained.

10. The fuel injection system according to claim 1 in which the sheath provides a closure on all sides.

11. The fuel injection system, according to claim 1, said high pressure delivery pump (3) is driven by a drive mechanism (26) and supplies fuel into said high pressure fuel reservoir (6) from which fuel is supplied via said pressure line (14) to at least one fuel injection valve (12), said at least one fuel injection valve is electrically controlled by said control device (9), a device (18) for detecting particular operational states or malfunctions of the fuel injection system, such as a leak in the high pressure conveying parts of the fuel injection system or a defective operational behavior of the engine, said device (18) can be switched by means of an electrically switchable coupling (27) between the high pressure delivery pump and drive mechanism (26) in order to switch off the drive mechanism (26) of the high pressure delivery pump (3).

12. The fuel injection system according to claim 3, in which a capture device (16, 25) for fuel discharging from the sheath is disposed underneath the sheath (15) and is provided with a fuel return.

13. The fuel injection system according to claim 4, in which a capture device (16, 25) for fuel discharging from the sheath is disposed underneath the sheath (15) and is provided with a fuel return.

14. The fuel injection system according to claim 5, in which a capture device (16, 25) for fuel discharging from the sheath is disposed underneath the sheath (15) and is provided with a fuel return.

15. The fuel injection system according to claim 2, in which the sheath provides a closure on all sides.

16. The fuel injection system according to claim 3, in which the sheath provides a closure on all sides.

17. The fuel injection system according to claim 4, in which the sheath provides a closure on all sides.

18. The fuel injection system according to claim 5, in which the sheath provides a closure on all sides.

19. The fuel injection system according to claim 6, in which the sheath provides a closure on all sides.

20. The fuel injection system according to claim 7, in which the sheath provides a closure on all sides.

* * * * *